US005347730A

United States Patent [19]

Rodriguez Colon

[11] Patent Number: 5,347,730

[45] Date of Patent: Sep. 20, 1994

[54] LOW HEEL SHOE CONVERTIBLE TO HIGH HEEL SHOE AND VICE VERSA WITH AN ADJUSTABLE SHANK

[75] Inventor: Jorge A. Rodriguez Colon, Río Piedras, P.R.

[73] Assignee: Commonwealth of Puerto Rico, San Juan, P.R.

[21] Appl. No.: 12,375

[22] Filed: Feb. 2, 1993

[51] Int. Cl.[5] ..... A43B 13/42

[52] U.S. Cl. ..... 36/76 R; 36/42; 36/100

[58] Field of Search ..... 36/100, 42, 36 C, 107, 36/36 R, 36 A, 36 B, 36 C, 41, 76 R, 76 C

[56] References Cited

U.S. PATENT DOCUMENTS

| | | | |
|---|---|---|---|
| 235,290 | 12/1880 | Plunkett et al. | 36/42 |
| 638,043 | 11/1899 | Burwell | 36/42 |
| 1,029,220 | 6/1912 | Powyszenski . | |
| 1,379,452 | 5/1921 | Lampkin . | |
| 1,494,590 | 5/1924 | Cook | 36/42 |
| 1,631,710 | 6/1927 | Tranides . | |
| 2,112,052 | 3/1938 | Smith | 36/100 |
| 2,258,265 | 10/1941 | Schwartz | 36/100 |
| 2,707,341 | 5/1955 | Romano | 36/100 |
| 2,767,489 | 10/1956 | Sturman . | |
| 3,464,126 | 9/1969 | Sarkissian | 36/100 |
| 3,646,497 | 2/1972 | Gillikin | 36/42 |
| 4,400,893 | 8/1983 | Musci | 36/42 |
| 4,416,072 | 11/1983 | Sarkissian | 36/100 |
| 4,670,996 | 6/1987 | Dill | 36/42 |
| 5,058,290 | 10/1991 | Koehl et al. | 36/42 |

FOREIGN PATENT DOCUMENTS

| | | | |
|---|---|---|---|
| 47935 | 11/1888 | Fed. Rep. of Germany | 36/42 |
| 322778 | 9/1919 | Fed. Rep. of Germany | 36/42 |
| 1465151 | 1/1966 | France | 36/42 |
| 74620 | 10/1917 | Switzerland | 36/42 |

*Primary Examiner*—Paul T. Sewell
*Assistant Examiner*—Thomas P. Hilliard
*Attorney, Agent, or Firm*—Oblon, Spivak, McClelland, Maier & Neustadt

[57] ABSTRACT

A shoe which is provided with a permanently attached low heel can be converted to a high heel shoe by attaching the high heel bodily to the low heel. Additionally, there is an adjustable shank for retaining the shoe in a shape conforming to its high heel condition or in a shape conforming to its low heel condition.

6 Claims, 4 Drawing Sheets

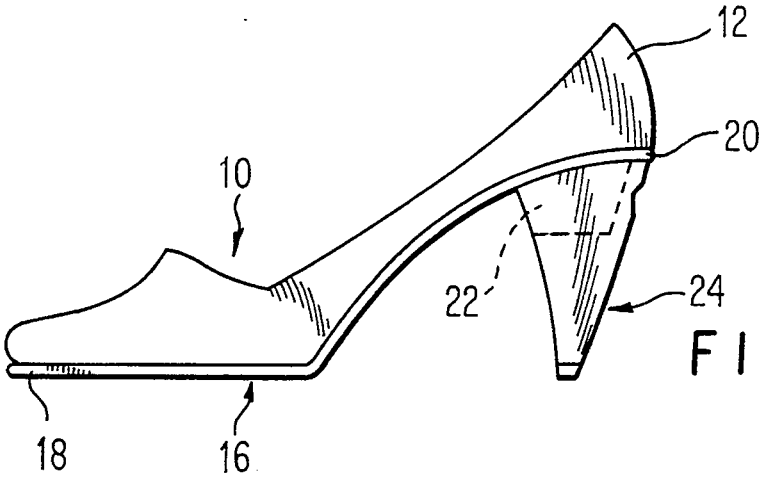
FIG. 2
FIG. 1
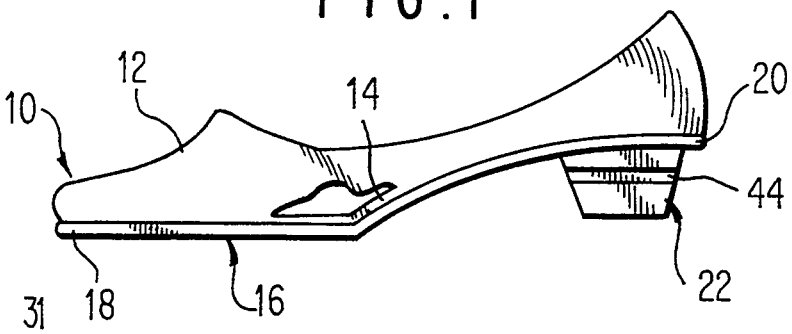
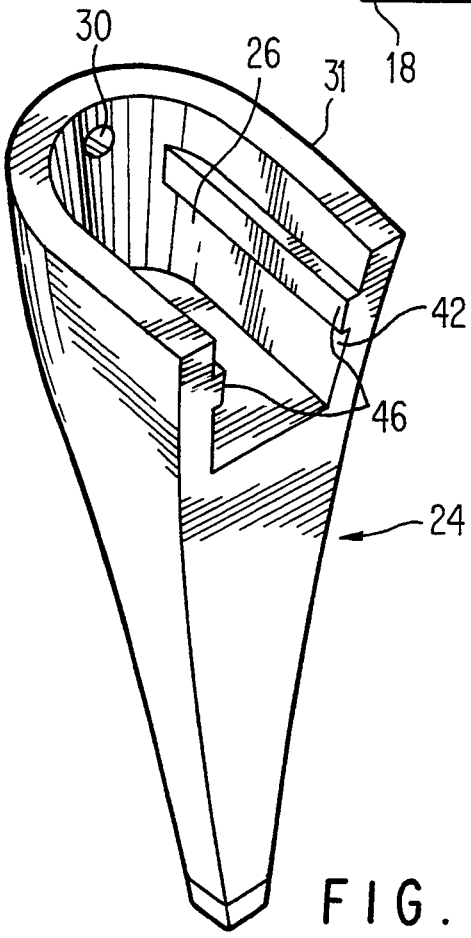
FIG. 3
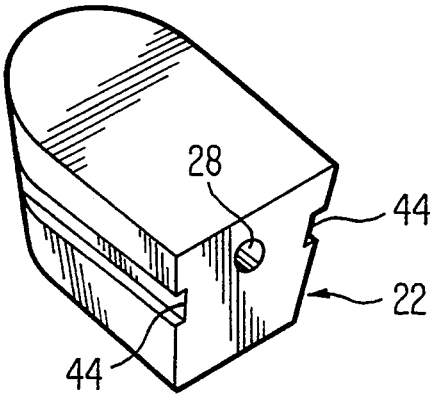
FIG. 4

FIG. 5
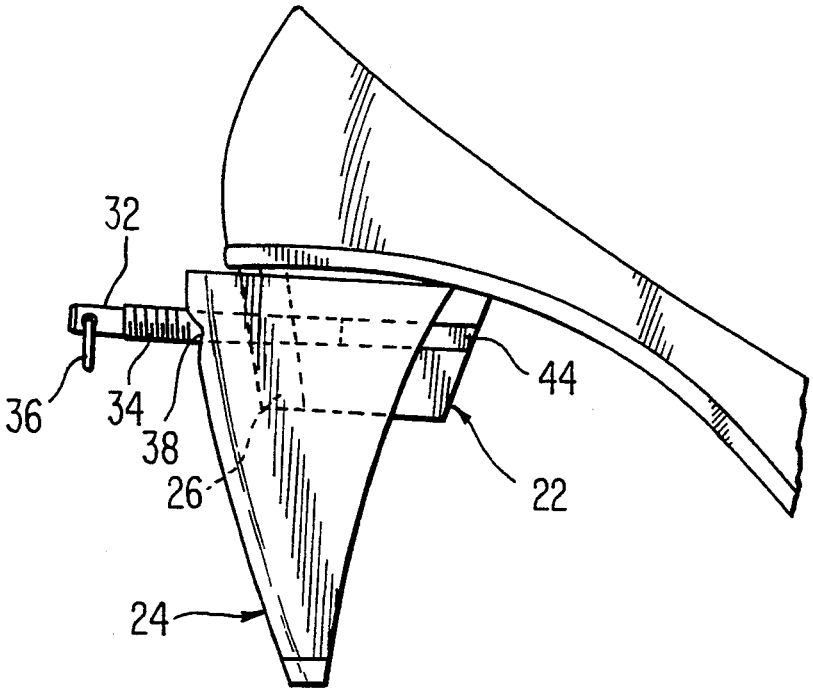
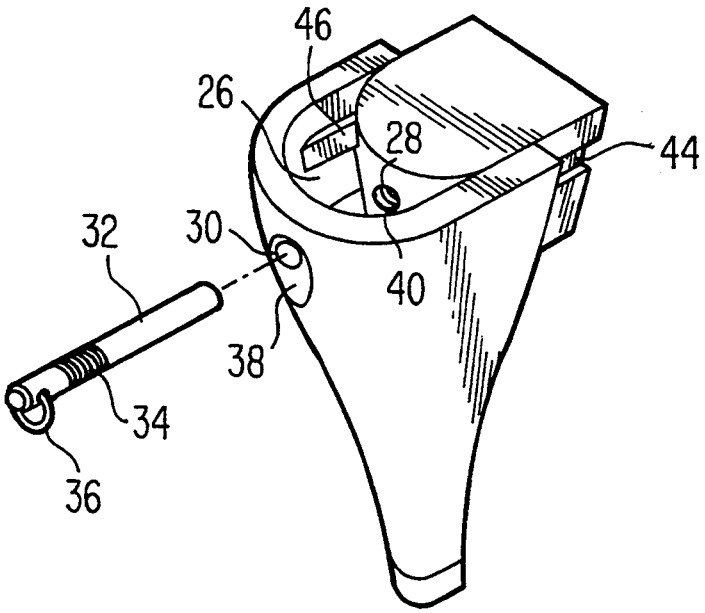
FIG. 6

LOW HEEL SHOE CONVERTIBLE TO HIGH HEEL SHOE AND VICE VERSA WITH AN ADJUSTABLE SHANK

FIELD OF THE INVENTION

This invention relates to shoes and more particularly to low heel shoes which may be quickly converted to high heel shoes and vice versa.

BACKGROUND OF THE INVENTION

There are in the prior art a vast number of patents for shoes having interchangeable heels whereby a shoe may be converted from a low heel shoe to a high heel shoe. In these prior patents, however, the heel end of the shoe is provided with mounting means to which heels of different heights can be attached. The problem with this arrangement is that each heel must carry mating attachment means which adds to expense, and should one set of heels be removed and not immediately replaced by another, and the shoes are nevertheless worn, as in an emergency, without heels the mounting means fixed to the shoes are likely to be destroyed beyond use and the shoes would then have to be discarded.

SUMMARY OF THE INVENTION

In view of the foregoing disadvantages of prior systems for changing heels of different heights, it is a principal object of the present invention to provide an arrangement for changing a shoe from low heel to high heel wherein the low heel is permanently attached to the shoe to serve as a normal low heel upon which the wearer can walk, with the low heel itself serving as the mounting means to which a high heel is releasably attached to convert the shoe from a low to a high heel shoe or vice versa.

Another object of the invention is to provide an extensible shank incorporated in the sole of the shoe which when the shoe is changed between high and low heels, can be manually adjusted by flexing the sole to a low or high heel condition whereby the shank retains the shape of the shoe corresponding to its low or high heel condition.

BRIEF DESCRIPTION OF THE DRAWINGS

FIG. 1 is a side elevational view, partly broken away, of a shoe with a permanently attached low heel;

FIG. 2 is a side elevational view of the shoe of FIG. 1 showing more or less a schematically a high heel attached to the low heel of FIG. 1;

FIG. 3 is an enlarged perspective view of a high heel conforming to the invention;

FIG. 4 is an enlarged perspective view of a low heel conforming to the invention;

FIG. 5 is a broken side elevational view of a shoe showing a high heel partially inserted over a low heel;

FIG. 6 is an exploded perspective view of the arrangement of FIG. 5 but with the shoe removed;

DETAILED DESCRIPTION OF THE INVENTION

Figure 7:
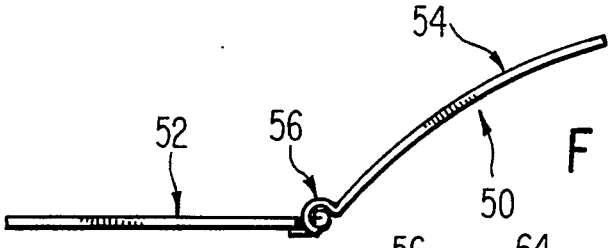
FIG. 7 is a side elevational view of an adjustable shank for use with shoes having changeable heels.
Figure 8:
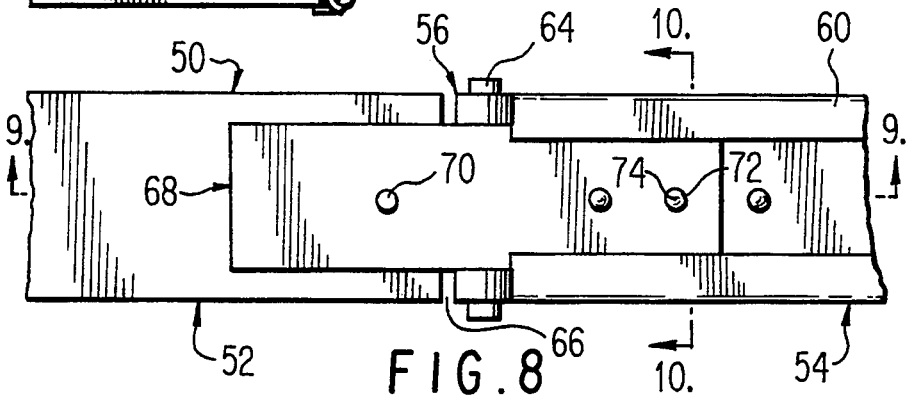
FIG. 8 is an enlarged broken plan view of the adjustable shank of FIG. 7.
Figure 9:
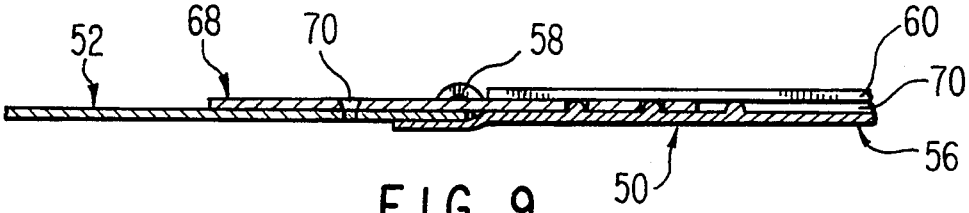
FIG. 9 is a vertical, longitudinal cross-sectional view taken substantially on the line 9—9 of FIG. 8.
Figure 10:
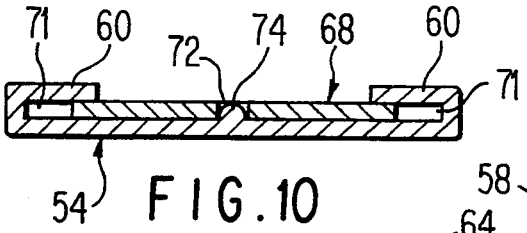
FIG. 10 is a vertical lateral cross-sectional view taken substantially on the line 10—10 of FIG. 9.

Referring now to the drawings the shoe 10 of the invention comprises an upper 12, an insole 14, a sole 16 having a toe end 18 and a heel end 20, and a relatively low heel 22 fastened substantially permanently to the heel end of the sole. The heel is said to be "substantially permanently" attached to the sole by which is meant the heel may be removed by extraordinary effort as can almost any heel but for the purposes of the invention the heel 22 is "permanently" attached to the sole and shall hereafter be so considered. The heel 22 is designed for supporting in use the heel of a wearer's foot at a first predetermined elevation above the ground. The invention includes a relatively high heel 22 as shown generally in FIG. 2 and more particularly in FIG. 3. In accordance with the invention, cooperating connecting means, as described in detail below, are carried by both the low heel 22 and high heel 24 for releasably fastening the high heel 24 to the low heel 22 for supporting the wearer's heel at a second predetermined elevation above the ground higher than the elevation provided by the low heel.

In accordance with the invention, the cooperating connecting means for attaching the high heel to the low heel comprises a recess 26 in the upper end of the high heel having a depth substantially equal to the height of the low heel 22 and a shape complementary to the shape of the low heel so as to permit slidable insertion of the high heel recess 26 over the low heel. The low heel 22 is provided with a first aperture 28 (FIG. 4) with there being a second aperture 30 in the high heel extending through the wall 31 of the recess from the outer surface of the heel into the recess 26, the first and second apertures 28, 30 being positioned in the respective heels 22, 24 as to align with each other when the low heel 22 is slid into the recess 26 in the high heel whereupon a pin 32 (FIG. 6) is insertable into the aligned apertures. The pin 32 carries first and second means, such as the external threads 34 and an enlargement, such as the foldable handle 36, for releasable engagement with cooperating parts of the respective high and low heels to retain the high heel in its position of use on the low heel.

The cooperating part of the high heel which is engaged by the enlargement or handle 36 on the end of the pin 32 is the region 38 (FIG. 6) around the high heel aperture 30 which region may be flattened or slightly recessed to ensure tight engagement of the handle with the region 38. The cooperating part of the low heel comprises internal threads 40 within the low heel aperture 28. It is within the purview of the invention for the external threads to be on the end of the pin remote from the handle 36 and for the high heel aperture to be provided with internal threads whereupon the pin 32 would be inserted in a rearward direction with the handle 36 engaging the region around the forward end of the low heel aperture 28, as the external threads of the pin are screwed into the internal threads of the high heel aperture.

Preferably the wall 31 of the recess 26 on the side of the high heel facing the toe 18 of the shoe 13 is open as best shown at 42 in FIG. 3 to enable the low heel 22 to be engaged in the recess 26 of the high heel 24 by moving the open side 42 of the recess towards the toe 18 of the shoe 10 until the rear face of the low heel is engaged by the front face of the wall 31 of the recess 26 opposite the open side 42 thereof.

To provide additional security against the high heel being forcibly rocked forwardly or rearwardly relative to the shoe sole, should the high heel strike an obstruction, the lateral sides of the low heel 22 contain longitudinally extending grooves 44 with the corresponding inner faces of the wall 31 of recess 26 in the high heel containing tongues 46 for close sliding engagement with the grooves 44 in the low heels.

Almost any woman's shoe, be it high heel or low heel, contains between the sole and insole a stiff metal shank which retains the shape of the shoe. The present invention provides an adjustable shank which performs the same function as the metal shank in shoes not intended to have changeable heels.

Figure 11:
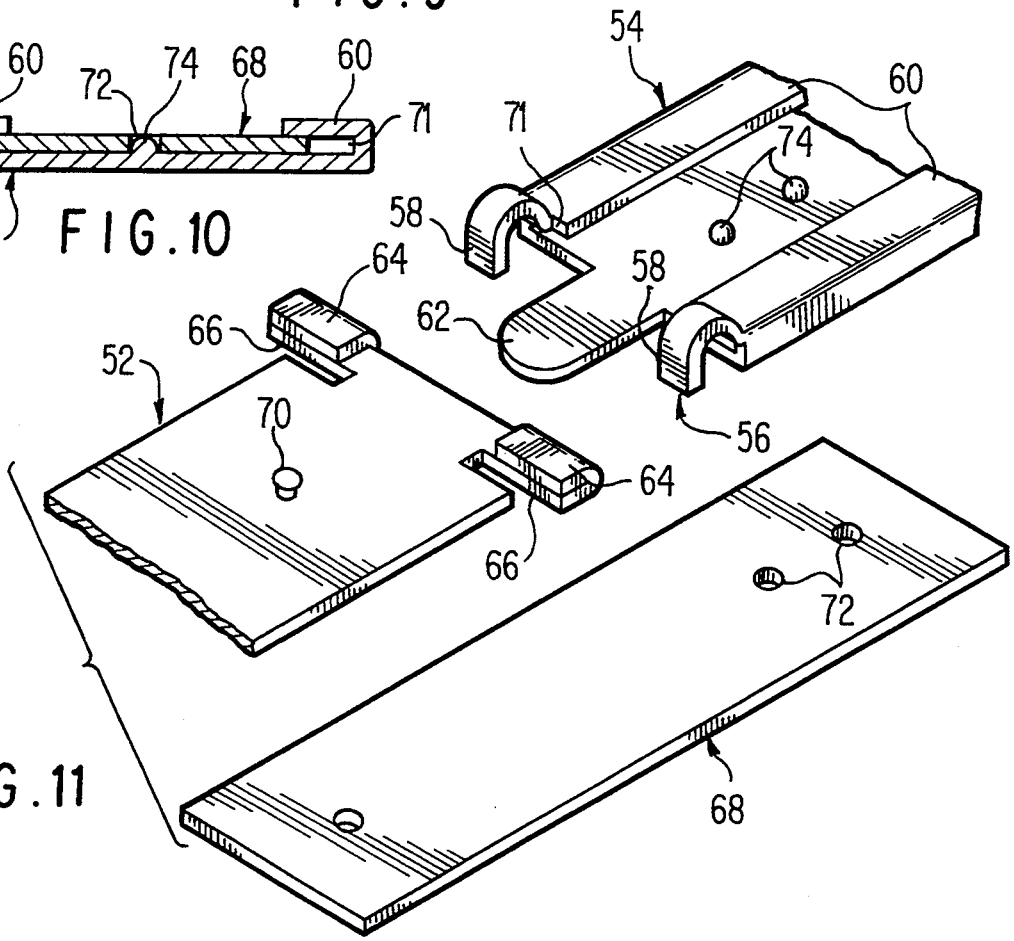
FIG. 11 is an enlarged broken, exploded perspective view showing the elements of the adjustable shank of the invention.
Figure 12:
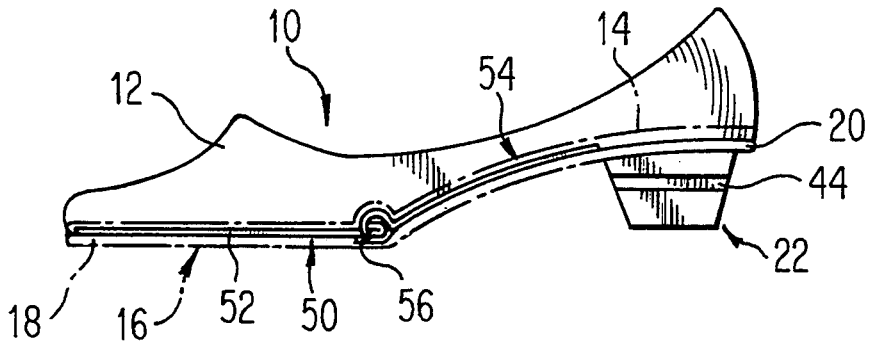
FIG. 12 is a somewhat schematic view showing the shank applied to a shoe in its low heel condition.
Figure 13:
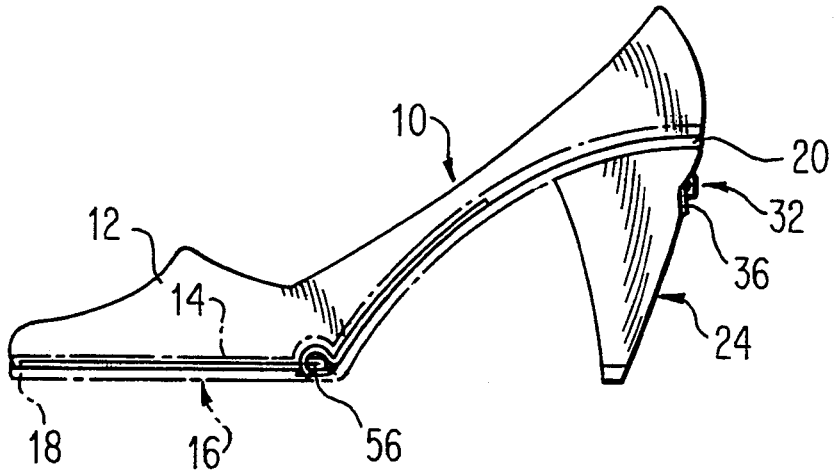
FIG. 13 is a view similar to FIG. 12 but showing the shank applied to a shoe in its high heel condition.

With reference now to FIGS. 7 through 13 the adjustable shank 50 is illustrated generally in FIGS. 12 and 13. Though for purpose of illustration some parts of the shank are shown oversize, the shank occupies the same position between the insole 14 and sole 16 as does a conventional one piece shank. The shank of the invention comprises a first leaf 52 anchored in conventional fashion in the forward part of the shoe sole and second leaf 54 anchored in the rear part of the shoe as shown in FIGS. 12 and 13. The second leaf 54 may be arcuate as shown in FIG. 7 to conform to the arch of the shoe which in turn conforms to the arch of the foot of the wearer. A hinge 56 interconnects the adjacent ends of the leaves 52, 54 and though the hinge can be of any desired configuration the hinge shown comprises a pair of forwardly extending, downwardly facing, arcuate horns 58 formed at the ends of bent over side parts 60 of the leaf 54. Extending forwardly from the front edge of the leaf 54 is a resilient tongue 62 which serves as a biasing spring acting again the under side of the leaf 52, (FIG. 9), when the horns 58 are hooked over laterally extending horns 64 and into slots 66 at the rear end of leaf 52. The tongue 62 biases the second leaf 54 towards a raised position relative to the first leaf 52. One end of a resilient detent strip 68, best seen in FIG. 11, is securely fastened by a rivet 70 to the leaf 52 adjacent the rear end thereof. The strip 68 extends past the hinge 56 into laterally opposed slots 71, best seen in FIG. 10, defined by the above mentioned bent-over side parts 60 of the leaf 54 which serve as means for guiding the strip 68 whereby upon relative angular movement of the leaves about the hinge, the strip is restrained to move in close parallel relationship over the second leaf 54 to bias it relative to the first leaf 52 in a direction opposite to the bias of the tongue 62.

Pairs of spaced detents such as apertures or recesses 72 in the free end of the strip 68 and rounded protuberances 74 on the leaf 54 interengage as the first and second leaves are manually angularly moved with respect to each other to relative positions corresponding to the high or low heel condition of the shoe. Because the shank of the invention is sandwiched between the sole 16 and insole 14, after the high heel, say, is joined to the low heel, the wearer manually exaggeratedly flexes the shoe until she hears the hole or holes 72 of the detent plate 68 snap over protuberances 74 of the leaf 54 whereupon the shape of the shoe remains in a high heel condition. When the shoe is restored to a low heel condition, the wearer flexes the shoe in the opposite direction whereupon the holes 72 in the detent plate cam over the rounded ends of those protuberances with which they were engaged until they have been moved to a position aligned with protuberances in positions corresponding to the shape of the shoe in its low heel condition. With the shoe in this condition were the wearer to stand on her toes so that detent pairs disengage, they will re-engage the instant the wearer returns to normal position relative to the ground and the shoe thereby returned to its low heel condition.

The use of the invention should be clear from the above description. Briefly, when the wearer wishes to change the shoe from a low heel to a high heel conditions, she slides the recess 26 of the high heel 24 over the low heel 22, inserts the pin 32 into the aligned apertures 28, 30, engages the threads on the pin with threads in the appropriate aperture depending on whether the pin is inserted in a rearward or forward direction, turns the pin by the handle 36 to screw the threads together until the handle tightly engages the region around the appropriate aperture, and thereafter flexes the sole until she hears the proper detent pair snap together. To return to a low heel condition, she reverses the procedure.

Those skilled in the art will recognize that when a shoe designed for use with low heels is flexed, as would occur when high heels are applied to the shoe the sides of the shoe can become bunched or pleated. However, some degree of pleating is tolerable and it is within the skill of the art for the shoe designer to so design the shoe as to minimize bunching, as by the appropriate use of straps for example.

Having now described the invention it is apparent that it is susceptible of a variety of changes and modifications without, however, departing from the scope and spirit of the appended claims.

I claim:

1. A shoe comprising an upper, an insole, a sole having toe and heel ends, a relatively low ground engaging heel fastened permanently to the heel end of said sole for supporting in use the heel of a wearer's foot at a first predetermined elevation above the ground, a relatively high heel, and cooperating connecting means carried by said low and high heels for releasably fastening said high heel to said low heel for supporting in use the heel of a wearer's foot at a second predetermined elevation above the ground higher than said first predetermined elevation, an adjustable shank between said sole and insole, said shank comprising a first leaf anchored in the front part of a shoe sole, a second leaf anchored in the rear part of the shoe sole, a hinge interconnecting adjacent ends of said leaves, a spring biasing said second leaf towards a raised angular position relative to said first leaf, a resilient detent strip having one end fixed to said first strip and its opposite end extending past said hinge to partly overlap said second leaf, means for guiding said strip so that upon relative angular movement of said leaves about said hinge said strip is restrained to move in close parallel relationship over said second leaf and bias it relative to the first leaf in a direction opposite to the bias of said spring, pairs of spaced detents on said strip and said second leaf, each pair comprising a protuberance on one of said strip and said second leaf and a recess on the other of said strip and said second leaf, said pairs of detents being arranged that when said second leaf is raised relative to said first leaf to a first predetermined angular position corresponding to a first condition of a shoe when worn with said high heel attached to said low heel, a first pair of spaced detents snap together to releasably retain said shoe in said first condition, said pairs of detents being arranged that when said second leaf is lowered relative to said first leaf to a second predetermined angular position corresponding to a second condition of a shoe when worn with a low heel, said first pair of detents detach from each other and a second pair of detents snap together to retain said shoe in its second condition.

2. The shoe according to claim 1 wherein said cooperating connecting means comprises a recess in the upper end of said high heel having a depth substantially equal to the height of said low heel and a shape complementary to the shape of said low heel to permit slidable insertion of said high heel recess over said low heel, a first aperture in said low heel and second aperture in said high heel extending from its outer surface into said recess, said first and second apertures being positioned to align with each other when said low heel is inserted into said recess in said high heel, a pin insertable into said apertures when aligned with each other, and first and second means carried by said pin for releasable engagement with cooperating parts of the respective high and low heels for retaining said high heel in its position of use on said low heel.

3. The shoe according to claim 2 wherein said first releasable engagement means comprises an enlargement on one end of said pin, and the cooperating part of said high heel comprises the region of said high heel surrounding said outer end of the aperture in said high heel engageable by said pin enlargement, said second releasable engagement means comprising external threads on at least that part of said pin received in the aperture in said low heel, and the cooperating part of said low heel comprises internal threads within the aperture in said low heel engageably by said external threads on said pin.

4. The shoe according to claim 3 wherein said enlargement on said one end of said pin comprises a foldable handle.

5. The shoe according to claim 3 wherein the wall of said recess on the side of said high heel facing the toe of said shoe is open to enable said low heel to be engaged in the recess of said high heel by moving the open side of said recess towards the toe of said shoe until said low heel is engaged by the wall of said recess opposite the open side thereof.

6. The shoe according to claim 5 wherein the lateral sides of said low heel contains longitudinally extending grooves and corresponding inner faces of said recess contain tongues for close sliding engagement with said grooves in said low heels.

* * * * *